US010458633B1

(12) United States Patent
Mai

(10) Patent No.: US 10,458,633 B1
(45) Date of Patent: Oct. 29, 2019

(54) DEFORMABLE AND QUICK-INSTALLATION ILLUMINATION LAMP

(71) Applicant: COOLUX LIGHTING COMPANY LIMITED, Shenzhen, Guangdong (CN)

(72) Inventor: Ilona Mai, Guangdong (CN)

(73) Assignee: COOLUX LIGHTING COMPANY LIMITED, Shenzhen, Guangdong (CN)

( * ) Notice: Subject to any disclaimer, the term of this patent is extended or adjusted under 35 U.S.C. 154(b) by 0 days.

(21) Appl. No.: 16/134,949

(22) Filed: Sep. 18, 2018

Related U.S. Application Data

(63) Continuation of application No. PCT/CN2018/101384, filed on Aug. 20, 2018.

(51) Int. Cl.

| | |
|---|---|
| ***F21V 21/22*** | (2006.01) |
| ***F21V 17/12*** | (2006.01) |
| ***F21V 17/16*** | (2006.01) |
| ***F21V 23/00*** | (2015.01) |
| ***F21V 21/096*** | (2006.01) |
| *F21Y 115/10* | (2016.01) |
| *F21Y 103/10* | (2016.01) |

(52) U.S. Cl.
CPC ..... *F21V 21/22* (2013.01); *F21V 17/12* (2013.01); *F21V 17/16* (2013.01); *F21V 21/096* (2013.01); *F21V 23/001* (2013.01); *F21V 23/003* (2013.01); *F21Y 2103/10* (2016.08); *F21Y 2115/10* (2016.08)

(58) Field of Classification Search
CPC . F21S 8/031; F21S 8/066; F21S 8/043; F21V 17/16; F21V 21/0965; F21V 21/04; F21V 21/046
See application file for complete search history.

(56) References Cited

U.S. PATENT DOCUMENTS

| | | | | |
|---|---|---|---|---|
| 6,450,668 | B1 | 9/2002 | Kotloff | |
| 9,618,172 | B1 * | 4/2017 | Means, III ..... | F21S 8/066 |
| 2002/0089857 | A1 | 7/2002 | Borders | |

(Continued)

FOREIGN PATENT DOCUMENTS

| | | | |
|---|---|---|---|
| CN | 204986643 | U | 1/2016 |
| CN | 206145527 | U | 5/2017 |

(Continued)

*Primary Examiner* — Alexander K Garlen
*Assistant Examiner* — Eric T Eide
(74) *Attorney, Agent, or Firm* — Winston Hsu

(57) ABSTRACT

A deformable and quick-installation illumination includes a central assembly, a first lateral assembly provided with lamp bars, and a second lateral assembly provided with lamp bars, the first lateral assembly is movably connected to one side of the central assembly, so that the first lateral assembly can retract or stretch, the second lateral assembly is movably connected to the other side of the central assembly, so that the second lateral assembly can retract or stretch, and the first lateral assembly and the second lateral assembly are both connected to the central assembly by using a limiting component, so that the illumination lamp can maintain a stretching state. A plurality of lamp bars can be installed on a building at a time, so that an installation procedure is simplified, thereby implementing quick installation, and reducing installation costs.

8 Claims, 5 Drawing Sheets

(56) References Cited

U.S. PATENT DOCUMENTS

| | | | | |
|---|---|---|---|---|
| 2005/0286256 | A1* | 12/2005 | Tran | E04B 9/006 362/404 |
| 2015/0362169 | A1* | 12/2015 | Hodrinsky | F21V 29/74 315/112 |
| 2016/0069522 | A1* | 3/2016 | Rao | F21K 9/27 362/219 |
| 2018/0051854 | A1* | 2/2018 | Ossi | F21S 8/026 |

FOREIGN PATENT DOCUMENTS

| | | | |
|---|---|---|---|
| CN | 206592875 | U | 10/2017 |
| CN | 108119820 | A | 6/2018 |

* cited by examiner

DEFORMABLE AND QUICK-INSTALLATION ILLUMINATION LAMP

CROSS REFERENCE TO RELATED APPLICATIONS

This application is a continuation application of PCT/CN2018/101384 filed on Aug. 20, 2018. The contents of the above-mentioned applications are all hereby incorporated by reference.

BACKGROUND OF THE INVENTION

1. Field of the Invention

The present invention relates to the field of illumination technologies, and in particular, to a deformable and quick-installation illumination lamp.

2. Description of the Prior Art

Due to the advantages of energy saving and environment protection owned by LED lamps, a growing number of conventional filament lamps, fluorescent lamps, and halogen lamps are replaced with LED lamps, and a large number of fluorescent lamp tubes are replaced with LED lamp bars. In actual application, housings of conventional lamps are kept, only parts such as fluorescent lamp tubes, rectifiers, and brackets in the conventional lamps are detached, and LED lamp bars are installed into the housings of the conventional lamps for mains supply. Currently, commercially available LED lamp bars are single. For a lamp housing in which a plurality of lamp bars need to be installed, the lamp bars need to be installed one by one. Consequently, the installation process is complex, time-consuming, and labor-consuming, leading to increased installation costs, and making it particularly impractical for use in areas with high labor costs.

SUMMARY OF THE INVENTION

The present invention is directed to provide a deformable and quick-installation illumination lamp, so as to resolve the technical problem in the prior art that lamp bars need to be installed one by one.

To resolve the foregoing technical problem, the present invention adopts the following technical solutions:

A deformable and quick-installation illumination lamp is provided with a plurality of lamp bars, where the illumination lamp includes a central assembly, a first lateral assembly provided with the lamp bars, and a second lateral assembly provided with the lamp bars, the first lateral assembly is movably connected to one side of the central assembly, so that the first lateral assembly can retract or stretch, the second lateral assembly is movably connected to the other side of the central assembly, so that the second lateral assembly can retract or stretch, and the first lateral assembly and the second lateral assembly are both connected to the central assembly by using a limiting component, so that the illumination lamp can maintain a stretching state.

Compared with the prior art, the present invention has the following beneficial effects:

When the illumination lamp is transported, the first lateral assembly and the second lateral assembly are both retracted, to facilitate transportation; when the illumination lamp is installed, the first lateral assembly and the second lateral assembly are caused to stretch, and the illumination lamp is caused to maintain a horizontal stretching state, so that a plurality of lamp bars can be installed on a building at a time, so that an installation procedure is simplified, thereby implementing quick installation and reducing installation costs.

These and other objectives of the present invention will no doubt become obvious to those of ordinary skill in the art after reading the following detailed description of the preferred embodiment that is illustrated in the various figures and drawings.

DETAILED DESCRIPTION

Referring to FIG. 1 to FIG. 5, the following describes implementations of the present invention in detail. It should be emphasized that the following description is merely exemplary, and is not intended to limit the scope and application of the present invention.

Figure 1:
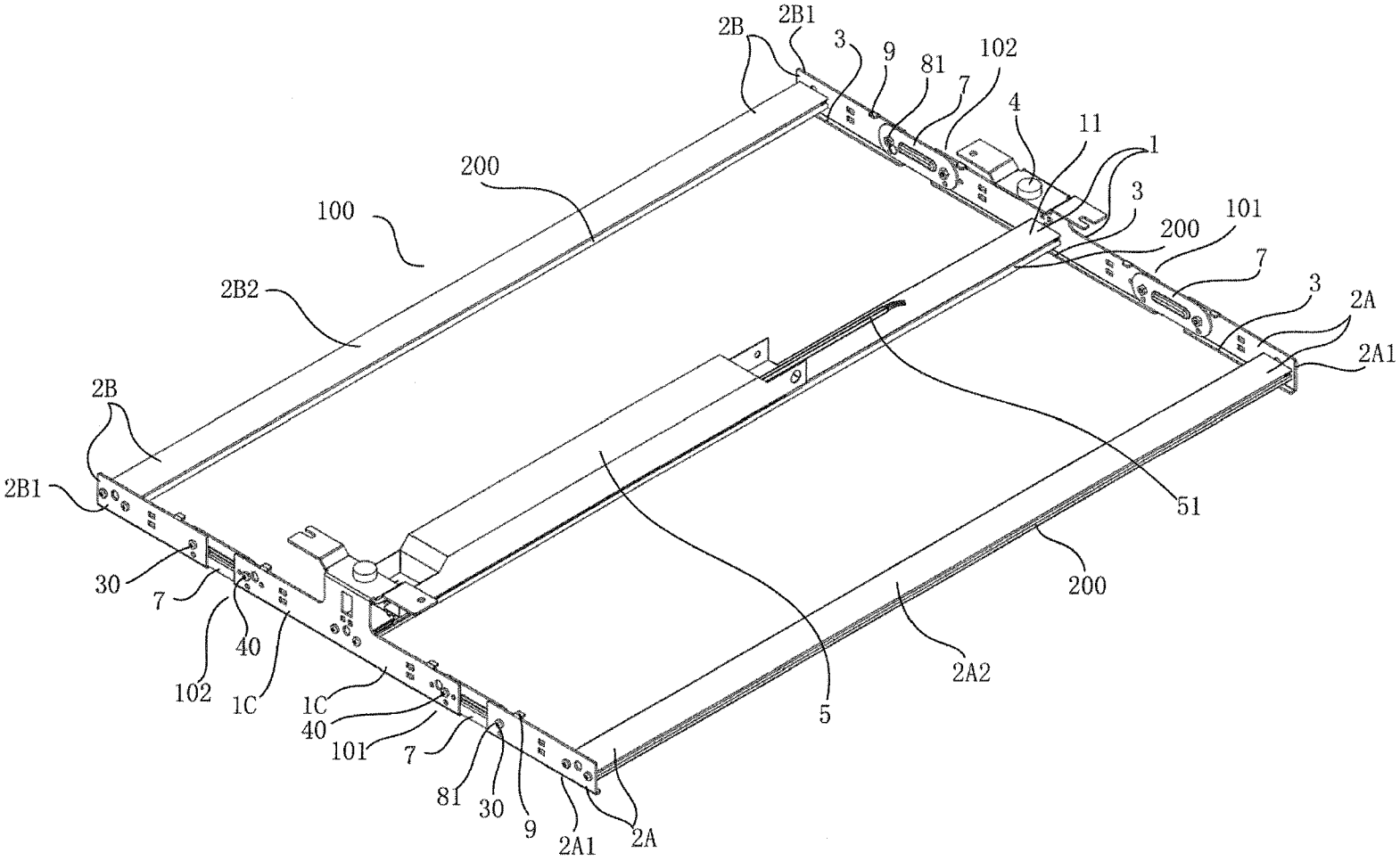
FIG. 1 is a schematic structural diagram of a deformable and quick-installation illumination lamp of the present invention in a horizontal stretching state.
Figure 2:
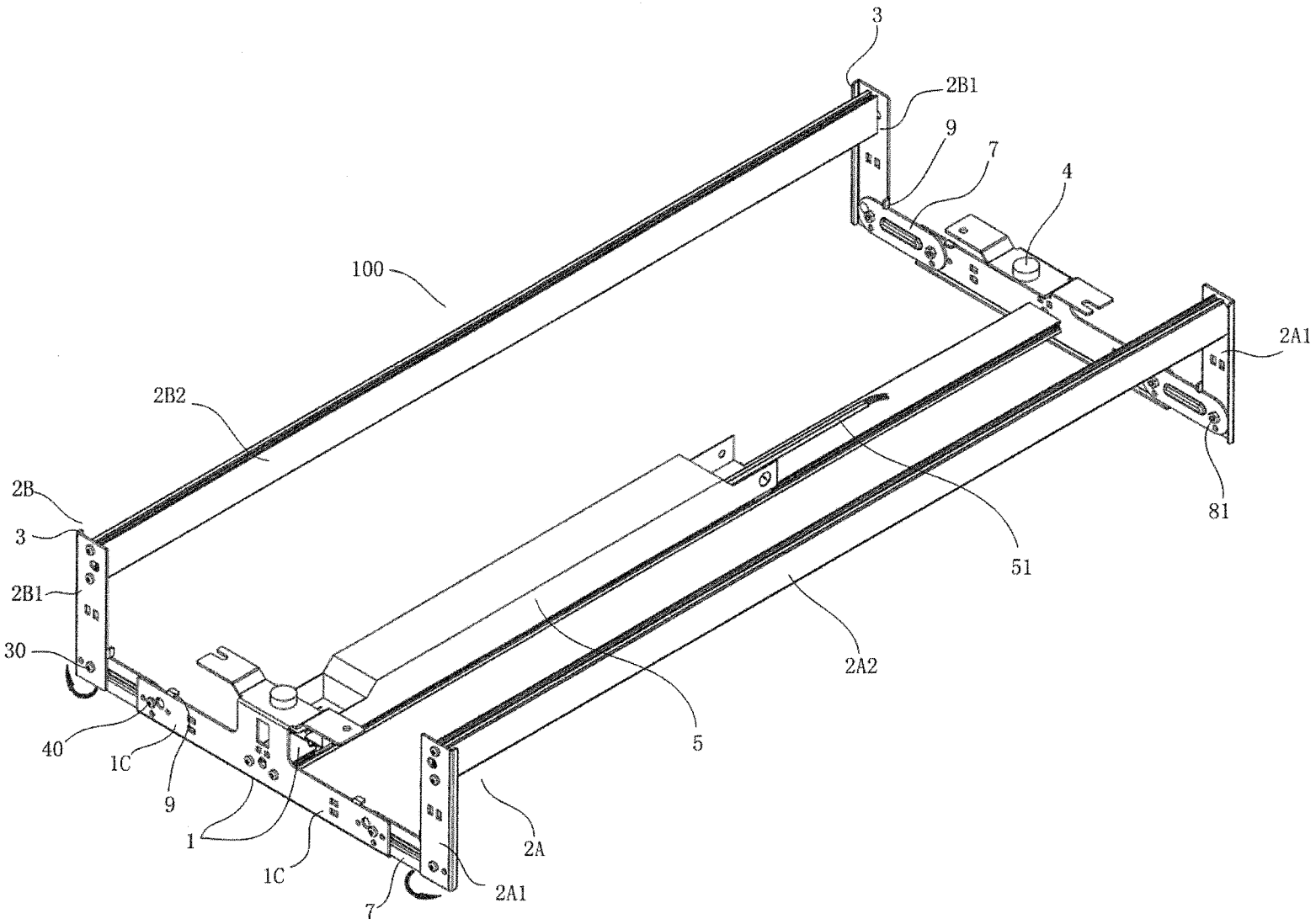
FIG. 2 is a schematic structural diagram of an illumination lamp of the present invention in a partially retracted state.

Referring to FIG. 1, a deformable and quick-installation illumination lamp 100 of the present invention is provided with a plurality of lamp bars 200. The lamp bar 200 is usually an LED lamp, and certainly may alternatively be a fluorescent lamp or a lamp of another type.

Figure 4:
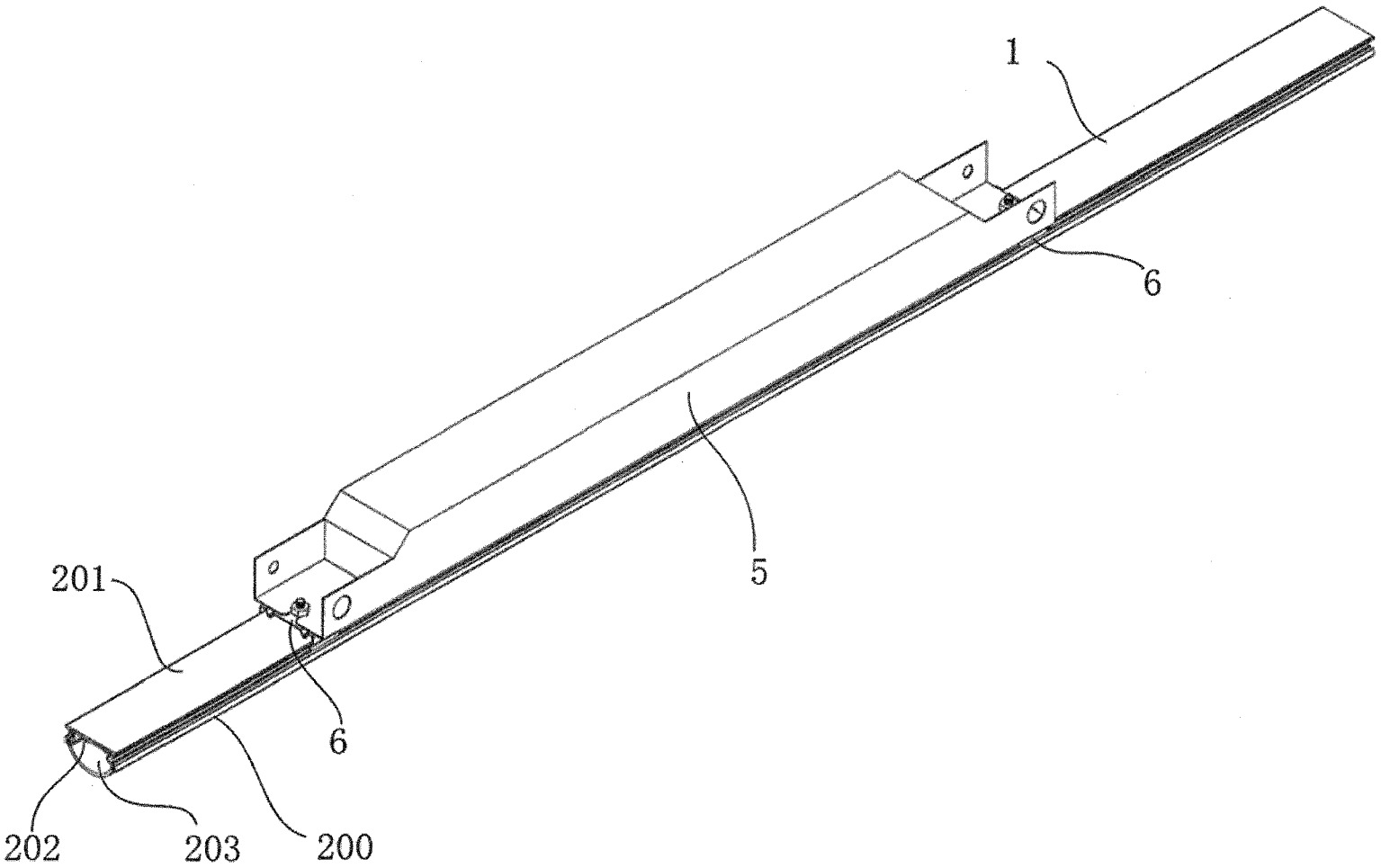
FIG. 4 is a partial schematic structural diagram of an illumination lamp of the present invention.

For example, referring to FIG. 4, the lamp bar 200 includes a lamp base 201, a lamp sheet 202, and a light transmissive component 203. The lamp sheet 202 can emit light after being powered on. The lamp sheet 202 is installed on the lamp base 201. The light transmissive component 203 allows light to pass therethrough. The light transmissive component 203 is connected to the lamp base 201 and covers the lamp sheet 202.

The shape of the illumination lamp 100 is usually a rectangle, and certainly, may alternatively be a shape with a closed external profile, such as a parallelogram, a polygon, a hexagon, a heptagon, or an octagon.

The present invention is described below by using a rectangular illumination lamp 100 as an example.

Referring to FIG. 1, the illumination lamp 100 includes a central assembly 1, a first lateral assembly 2A provided with lamp bars 200, and a second lateral assembly 2B provided with lamp bars 200. The central assembly 1 is configured to connect the first lateral assembly 2A to the second lateral assembly 2B, and may be a section edge of the rectangular illumination lamp 100, or may be an edge connecting two parallel edges.

To increase the number of lamp bars, lamp bars 200 may also be disposed on the central assembly 1. That is, the central assembly 1, the first lateral assembly 2A, and the second lateral assembly 2B may all include lamp bars 200.

The first lateral assembly 2A and the second lateral assembly 2B may be two assemblies symmetrical about a central axis of the central assembly 1.

Referring to FIG. 1, the first lateral assembly 2A is movably connected to one side 101 of the central assembly 1, so that the first lateral assembly 2A can retract or stretch. The second lateral assembly 2B is movably connected to the other side 102 of the central assembly 1, so that the second lateral assembly 2B can retract or stretch. A manner of movable connection may be rotatable connection or slide connection. Retraction includes folding and contraction. For the rotatable connection, the retraction is folding, and for the slide connection, the retraction is contraction. Deformation also includes folding and contraction.

Referring to FIG. 1, the first lateral assembly 2A is connected to the central assembly 1 by using a limiting component 3, so that the illumination lamp 100 can maintain a stretching state, for example, a horizontal stretching state. The second lateral assembly 2B is connected to the central assembly 1 by using a limiting component 3, so that the illumination lamp 100 can maintain a stretching state, for example, a horizontal stretching state.

The limiting component 3 may be a fastening member, or a part on the first lateral assembly 2A, the second lateral assembly 2B, or the central assembly 1. The first lateral assembly 2A or the second lateral assembly 2B is movably connected to one side 101 of the central assembly 1, and the first lateral assembly 2A or the second lateral assembly 2B can retract or stretch. When the first lateral assembly 2A or the second lateral assembly 2B horizontally stretches, the illumination lamp 100 is in a horizontal stretching state. Due to the existence of the limiting component 3, the limiting component 3 fixes the first lateral assembly 2A or the second lateral assembly 2B to the central assembly 1, so that the illumination lamp 100 maintains a horizontal stretching state.

When the deformable and quick-installation illumination lamp of the present invention is transported, the first lateral assembly 2A and the second lateral assembly 2B are both retracted. In this way, space is saved, product packaging and transportation are facilitated, and costs are reduced. When the illumination lamp is installed, the first lateral assembly 2A and the second lateral assembly 2B are caused to stretch, and the limiting component 3 causes the illumination lamp 100 to maintain a horizontal stretching state, and then the illumination lamp 100 is installed onto a building, for example, a lamp housing on a ceiling.

According to the foregoing description, it can be learned that when the illumination lamp is transported, the first lateral assembly 2A and the second lateral assembly 2B are both retracted, to facilitate transportation; when the illumination lamp is installed, the first lateral assembly 2A and the second lateral assembly 2B are caused to stretch, and the illumination lamp 100 is caused to maintain a horizontal stretching state, so that a plurality of lamp bars 200 can be installed on a lamp housing at a time, so that an installation procedure is simplified, thereby implementing quick installation and reducing installation costs.

The present invention is further described below.

The deformable and quick-installation illumination lamp of the present invention further includes a plurality of connection plates 7. The first lateral assembly 2A is rotatably connected to one side 101 of the central assembly 1 by using the connection plate 7. That is, the connection plate 7 connects the first lateral assembly 2A to one side 101 of the central assembly 1. The second lateral assembly 2B is rotatably connected to the other side 102 of the central assembly 1 by using the connection plate 7. That is, the connection plate 7 connects the second lateral assembly 2B to the other side 102 of the central assembly 1.

Figure 3:
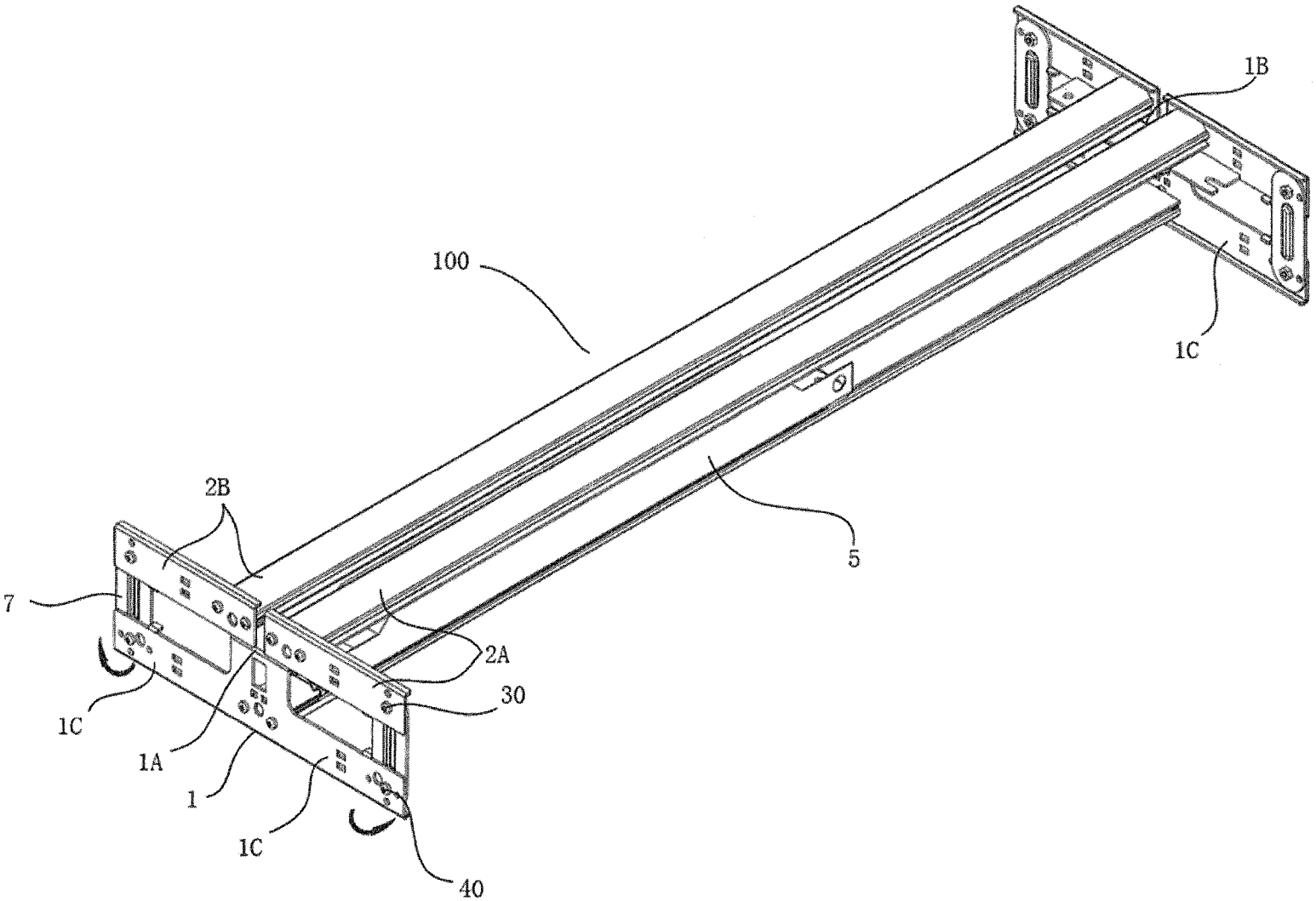
FIG. 3 is a schematic structural diagram of an illumination lamp of the present invention in a retracted state.

The first lateral assembly 2A can rotate in a range of 90° relative to the connection plate 7. That is, the first lateral assembly 2A can rotate around a joint 30 between the first lateral assembly 2A and the connection plate 7. However, due to the existence of the limiting component 3, the first lateral assembly 2A can only rotate within a range of 90° around the joint 30. Similarly, the second lateral assembly 2B can rotate in a range of 90° relative to the connection plate 7. The connection plate 7 can rotate in a range of 90° relative to the central assembly 1. That is, the connection plate 7 can rotate around a central joint 40 between the connection plate 7 and the central assembly 1. However, due to the existence of the limiting component 3, the connection plate 7 can only rotate within a range of 90° around the central joint 40. In this way, referring to FIG. 2, first, the first lateral assembly 2A and the second lateral assembly 2B are rotated around the joint 30 by 90°. Referring to FIG. 3, the connection plate 7 is then rotated around the central joint 40 by 90°, so that the first lateral assembly 2A and the second lateral assembly 2B come into contact with the central assembly 1 by means of retraction, for example, rotation by 180°. For example, the first lateral assembly 2A and the second lateral assembly 2B come into contact with two ends 1A and 1B of the central assembly 1. In this way, the structure of the illumination lamp is compact, and the components come into contact with each other, for example, come into contact with a side surface connection component 1C, allowing for convenient and firm packaging, thereby ensuring the reliability of the product after transportation.

The illumination lamp provided with a plurality of connection plates 7 is further described below.

Referring to FIG. 1, in one case, the illumination lamp further includes a plurality of first fixing components 81 and a plurality of positioning components 9. The first fixing component 81 may be a fastening member, for example, a screw. The positioning component 9 may be a protrusion.

The first lateral assembly 2A is rotatably connected to the connection plate 7 by using the first fixing component 81. The first lateral assembly 2A is provided with the positioning component 9. The positioning component 9 may come into contact with the connection plate 7, so that the first lateral assembly 2A forms a 90° angle with the connection plate.

Similarly, the second lateral assembly 2B is rotatably connected to the connection plate 7 by using the first fixing component 81. The second lateral assembly 2B is provided with the positioning component 9. The positioning component 9 may come into contact with the connection plate 7, so that the second lateral assembly 2B forms a 90° angle with the connection plate 7.

The connection plate 7 is rotatably connected to the central assembly 1 by using the first fixing component 81. The central assembly 1 is provided with the positioning component 9. The connection plate 7 may come into contact with the positioning component 9, so that the connection plate 7 forms a 90° angle with the central assembly 1.

The advantage of the foregoing configuration is that the positioning component 9 is disposed on the first lateral assembly 2A, the second lateral assembly 2B, and the central assembly 1, and together with the limiting component 3 disposed on the first lateral assembly 2A and the second lateral assembly 2B, enables the illumination lamp 100 to maintain a horizontal stretching state more stably.

The specific structures of the first lateral assembly 2A, the second lateral assembly 2B, and the central assembly 1 are exemplarily described below. Referring to FIG. 1, the first lateral assembly 2A is provided with two first elongated plates 2A1 and a first connection unit 2A2, and the first connection unit 2A2 connects the two first elongated plates 2A1 together, so that the two first elongated plates 2A1 are located on two ends of the first connection unit 2A2. Similarly, the second lateral assembly 2B is provided with two second elongated plates 2B1 and a second connection unit 2B2. The central assembly 1 is provided with a central connection component 11 and two side surface connection components 1C. The central connection component 11 connects the two side surface connection components 1C together, so that the two side surface connection components 1C are located on two ends of the central connection component 11. Bottom edges of the first elongated plate 2A1, the second elongated plate 2B1, and the side surface connection component 1C are all provided with the limiting component 3, and top edges of the first elongated plate 2A1, the second elongated plate 2B1, and the side surface connection component 1C are all provided with the positioning component 9. The connection plate 7 connects the first elongated plate 2A1 to the side surface connection component 1C, and connects the second elongated plate 2B1 to the side surface connection component 1C. When the first lateral assembly 2A and the second lateral assembly 2B are in a horizontal stretching state, the connection plate 7 is located between the limiting component 3 and the positioning component 9.

The first connection unit 2A2, the second elongated plate 2B1, and the central connection component 11 may all be formed by connecting a support plate to the lamp bars 200, or are lamp bars 200. Because the lamp bar 200 has rigidity, the lamp bar 200 can be used as one of connection components of the assembly. According to actual requirements, the central connection component 11 may alternatively be a support plate, for example, a metal plate.

Figure 5:
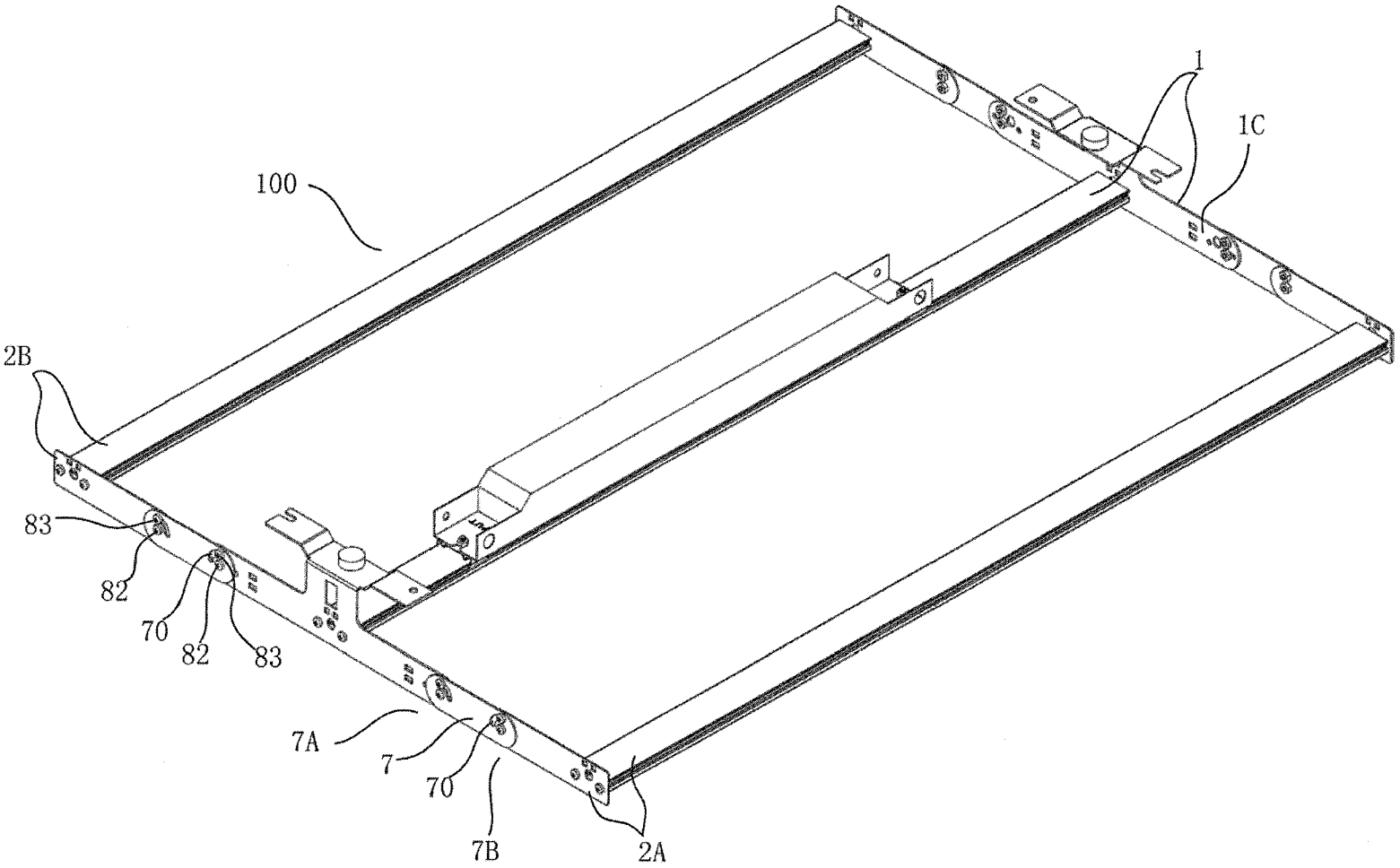
FIG. 5 is a schematic structural diagram of a variant of an illumination lamp of the present invention.

Referring to FIG. 5, in another case, the illumination lamp includes a plurality of second fixing components 82 and a plurality of third fixing components 83, and guide long holes 70 are formed on both ends 7A and 7B of the connection plate 7. The second fixing component 82 and the third fixing component 83 may be fastening members, for example, screws or bolts.

The first lateral assembly 2A is connected to the connection plate 7 by using the second fixing component 82 and the third fixing component 83. The third fixing component 83 is located in the guide long hole 70, and can move in the guide long hole 70. In this way, the first lateral assembly 2A is rotatably connected to the connection plate 7. Specifically, the guide long hole 70 is an arc-shaped hole, for limiting a rotation angle of the first lateral assembly 2A; a central angle of the guide long hole 70 is 90°, so that the first lateral assembly 2A can rotate in a range of 90° relative to the connection plate 7; the first lateral assembly 2A rotates around the second fixing component 82, and the third fixing component 83 moves in the guide long hole 70 along with the rotation of the first lateral assembly 2A.

Similarly, the second lateral assembly 2B is rotatably connected to the connection plate 7 by using the second fixing component 82 and the third fixing component 83, and the third fixing component 83 can move in the guide long hole 70. The second lateral assembly 2B can rotate in a range of 90° relative to the connection plate 7.

The connection plate 7 is rotatably connected to the central assembly 1 by using the second fixing component 82 and the third fixing component 83. The third fixing component 83 can move in the guide long hole 70. The guide long hole 70 is an arc-shaped hole, for limiting a rotation angle of the connection plate 7. A central angle of the guide long hole 70 is 90°, so that the connection plate 7 can rotate in a range of 90° relative to the central assembly 1. The connection plate 7 rotates around the second fixing component 82, and the third fixing component 83 moves in the guide long hole 70 along with the rotation of the connection plate 7.

The connection plate 7 provided with the guide long hole 70 is the limiting component 3.

Certainly, to facilitate installation, a suction component 4, for example, a magnet, may be disposed on the illumination lamp 100. First, the illumination lamp 100 is sucked onto a lamp housing on a ceiling by using the suction component 4, and then the entire illumination lamp 100 is fixed on the ceiling by using a fastening member.

Referring to FIG. 4, the deformable and quick-installation illumination lamp 100 of the present invention further includes a driving unit 5 and an elastic component 6. The driving unit 5 is configured to drive the lamp bars 200. The elastic component 6 has elasticity, and can be tightly clamped on the central assembly 1, for example, on the lamp base 201 of the lamp bar 200. The driving unit 5 is fixedly connected to the elastic component 6 by using a fastening member, so as to fix the driving unit 5 to the illumination lamp 100. A conducting wire 51 led out by the driving unit 5 is fixed along a surface of the illumination lamp 100, for example, is fixed to the side surface connection component 1C, the connection plate 7, the first elongated plate 2A1, and the second elongated plate 2B1, and is connected to each lamp bar 200. Certainly, other conducting wires may also be fixed along the surface of the illumination lamp 100. These configurations can be completed when the illumination lamp leaves the factory. In this way, the speed of installing the illumination lamp to a lamp housing can be further improved.

The present invention makes the product integral as a whole, and improves the convenience of packaging and transportation of the product, simplifies an installation procedure, and also ensures that the product is tidy and ordered after installation, so that costs can be reduced. The overall appearance of the product is improved when functionality is satisfied.

The above contents are detailed descriptions of the present invention in conjunction with specific/preferred implementations, and it should not be considered that the specific implementations of the present invention are limited to these descriptions.

Those of ordinary skill in the art may also make some replacements or modifications without departing from the conception of the present invention and all of such replacements or modifications should be considered to be within the protection scope of the present invention.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A deformable and quick-installation illumination lamp, wherein the illumination lamp comprises a central assembly, a first lateral assembly provided with lamp bars, and a second lateral assembly provided with lamp bars, the first lateral assembly is movably connected to one side of the central assembly, so that the first lateral assembly can retract or stretch, the second lateral assembly is movably connected to the other side of the central assembly, so that the second lateral assembly can retract or stretch, and the first lateral assembly and the second lateral assembly are both connected to the central assembly by using a limiting component, so that the illumination lamp can maintain a stretching state;

further comprising a plurality of connection plates, wherein the first lateral assembly is rotatably connected to one side of the central assembly by using a first connection plate of the plurality of connection plates, and the second lateral assembly is rotatably connected to the other side of the central assembly by using a second connection plate of the plurality of connection plates; the first lateral assembly can rotate within a range of 90° relative to the first connection plate, the second lateral assembly can rotate within a range of 90° relative to the second connection plate, and the first and second connection plates can rotate within a range of 90° relative to the central assembly, so that the first lateral assembly and the second lateral assembly can come into contact with the central assembly by means of retraction;

further comprising a plurality of first fixing components and a plurality of positioning components, wherein the first lateral assembly is rotatably connected to the first connection plate by using a first first fixing component of the plurality of first fixing components, the first lateral assembly is provided with a first positioning component of the plurality of positioning components, and the first positioning component can come into contact with the first connection plate, so that the first lateral assembly forms a 90° angle with the first connection plate; the second lateral assembly is rotatably connected to the second connection plate by using a second first fixing component of the plurality of first fixing components, the second lateral assembly is provided with a second positioning component of the plurality of positioning components, and the second positioning component can come into contact with the second connection plate, so that the second lateral assembly forms a 90° angle with the second connection plate; the first connection plate is rotatably connected to the central assembly by using a third first fixing component of the plurality of first fixing components, the central assembly is provided with a third positioning component, and the first connection plate can come into contact with the third positioning component, so that the connection plate forms a 90° angle with the central assembly.

2. The illumination lamp according to claim 1, wherein the first lateral assembly is rotatably connected to one side of the central assembly, and the second lateral assembly is rotatably connected to the other side of the central assembly.

3. The illumination lamp according to claim 1, further comprising a plurality of second fixing components and a plurality of third fixing components, wherein long guide holes are formed on two ends of the plurality of connection plates, the first lateral assembly is rotatably connected to the first connection plate by using a first the second fixing component of the plurality of second fixing components and a first third fixing component of the plurality of third fixing components, the first third fixing component can move in a first long guide hole, the second lateral assembly is rotatably connected to the second connection plate by using a second second fixing component of the plurality of second fixing components and a second third fixing component of the plurality of third fixing components, the second third fixing component can move in a second long guide hole, the second connection plate is rotatably connected to the central assembly by using a third second fixing component of the plurality of second fixing components and a third third fixing component of the plurality of third fixing components, and the third fixing component can move in a third long guide hole.

4. The illumination lamp according to claim 1, wherein the first lateral assembly is provided with a first elongated plate, the second lateral assembly is provided with a second elongated plate, side surface connection components are disposed on two sides of the central assembly, bottom edges of the first elongated plate, the second elongated plate, and the side surface connection component are all provided with the limiting component, top edges of the first elongated plate, the second elongated plate, and the side surface connection component are all provided with the positioning component, the connection plate connects the first elongated plate to the side surface connection component, the connection plate connects the second elongated plate to the side surface connection component, and the connection plate can be located between the limiting component and the positioning component.

5. The illumination lamp according to claim 1, further comprising a conducting wire, wherein the conducting wire is fixed along a surface of the illumination lamp.

6. The illumination lamp according to claim 1, further comprising a suction component disposed on the illumination lamp.

7. The illumination lamp according to claim 1, further comprising a driving unit, wherein the driving unit is fixed on the illumination lamp.

8. The illumination lamp according to claim 5, further comprising an elastic component, wherein the elastic component is tightly clamped on the central assembly, and the driving unit is fixedly connected to the elastic component.

* * * * *